US006608673B2

(12) United States Patent
Akiyama et al.

(10) Patent No.: US 6,608,673 B2
(45) Date of Patent: Aug. 19, 2003

(54) METHOD AND APPARATUS FOR OBTAINING OPTICAL CENTER LENS, ATTACHING LENS TO A LENS HOLDER, AND PRODUCING LENS

(75) Inventors: Hisanori Akiyama, Shinjyuku-ku (JP); Masahiro Jinbo, Shinjyuku-ku (JP); Masahiko Samukawa, Shinjyuku-ku (JP); Toshiro Yoda, Shinjyuku-ku (JP)

(73) Assignee: Hoya Corporation, Tokyo (JP)

( * ) Notice: Subject to any disclaimer, the term of this patent is extended or adjusted under 35 U.S.C. 154(b) by 0 days.

(21) Appl. No.: 09/978,578

(22) Filed: Oct. 18, 2001

(65) Prior Publication Data

US 2002/0060787 A1 May 23, 2002

(30) Foreign Application Priority Data

Oct. 23, 2000 (JP) ..... 2000-322790

(51) Int. Cl.[7] ..... G01B 9/00
(52) U.S. Cl. ..... 356/127; 356/124
(58) Field of Search ..... 356/127, 124

(56) References Cited

U.S. PATENT DOCUMENTS 5,210,695 A 5/1993 Wood
5,638,169 A 6/1997 Hollmann et al.
5,844,671 A 12/1998 Kajino et al.
6,145,989 A * 11/2000 Ikezawa et al. ..... 351/216

FOREIGN PATENT DOCUMENTS

| | | |
|---|---|---|
| DE | 31 44 179 A1 | 7/1982 |
| EP | 0 753 781 A2 | 1/1997 |
| EP | 0 990 484 A1 | 4/2000 |

OTHER PUBLICATIONS

European Search Report dated Jan. 29, 2003 for Application No. EP 01 12 4143.

* cited by examiner

*Primary Examiner*—Frank G. Font
*Assistant Examiner*—Roy M. Punnoose
(74) *Attorney, Agent, or Firm*—Griffin & Szipl, P.C.

(57) ABSTRACT

The present invention provides a method and apparatus for automatically and continuously conducting the layout analysis, the blocking (attachment) of an uncut lens to a lens holder, and the process of grinding an edge of three types of lenses, such as a single-vision lens, a progressing multifocal lens and a multifocal lens, utilizing a calculated approximation of the optical center of the uncut lens and by determining the position to which a lens holder should attach to the uncut lens.

11 Claims, 5 Drawing Sheets

METHOD AND APPARATUS FOR OBTAINING OPTICAL CENTER LENS, ATTACHING LENS TO A LENS HOLDER, AND PRODUCING LENS

FIELD OF THE INVENTION

The present invention relates to a method for obtaining a position of an optical center of a spectacle lens, and a method for attaching a lens holder to an uncut lens. The lens holder is a jig attached in advance to a rotational center axis of the uncut lens prior to a process of grinding an edge of a spectacle lens. The present invention also includes an apparatus for attaching the lens holder to the uncut lens before the process of grinding.

BACKGROUND OF THE INVENTION

A spectacle glass, or eyeglass lens, is prepared by processing an uncut spectacle lens (in general, a so-called round lens having a circular shape) into a shape for fitting into the shape of a spectacle frame, then fitting the cut spectacle lens into the spectacle frame. To prepare the uncut spectacle glass for cutting, it is necessary to conduct a layout analysis for determining the position of the optical lens center based on the eye prescription data (the dioptric power, the cylindrical dioptric power, the distance between the right and left eyes and other like data) and spectacle frame shape data with respect to the person who will be wearing the spectacle glass. In other words, it is important to determine the position of the optical lens center, which is a function of both the prescription of the eyeglass lens and the shape of the eyeglass lens frame, to produce a superior eyeglass lens.

The layout analysis is conducted to ensure that the optical center (in the case of a single vision lens) or the eyepoint (in the case of a multifocal lens) of the spectacle lens is aligned with the center of the pupil of the person who will be wearing a pair of eye glasses or a monocle fitted with properly prepared and cut spectacle lens glass. The layout analysis is needed because it is rather rare for a person to pick out an eyeglass or spectacle frame that has the geometrical center of the spectacle frame shape properly aligned and positioned in line with the person's pupil center. Therefore, if an uncut spectacle lens is processed merely with the intent of aligning the geometrical center of the lens frame shape with the position of the optical center of the lens, then a problem arises because the pupil center is not necessarily aligned with the geometrical center of the frame and the optical center of the lens. The proper alignment between the optical center of the lens and the pupil center of the spectacle wearer is critical for providing the best vision correction with the least amount of eye strain. Therefore, it is more important to align the optical center of the lens with the wearer's pupil than it is to align the optical center with the geometrical center of the spectacle frame. To achieve this proper alignment between the wearer's pupil and the optical lens center, it becomes necessary to move the optical center from the geometrical center of the frame and into alignment with the pupil center during the process of fitting the processed lens into the spectacle frame and adjusting the fit while the spectacle is worn.

Once the layout analysis has been completed, an uncut prescribed lens, which satisfies the conditions determined by the above layout analysis and satisfies the eyeglass prescription required by the person who will be wearing the spectacle glass, is selected and then processed. The processing of the uncut lens is conducted using an apparatus for processing a lens which grinds edge portions of the uncut lens by a grinder or a cutter while the uncut lens is rotated around a specific axis approximately perpendicular to the optical face of the uncut lens. When processing the uncut lens using the apparatus for processing a lens, a lens holder is used. The lens holder is a jig that provides a rotational center axis for the uncut lens and is attached to the uncut lens prior to processing.

Previously, the prior art lens holder was attached at the optical center position of the uncut lens in the case of a single-vision lens. In the case of a progressive multifocal lens or a multifocal lens (typically, a bifocal lens), the lens holder was attached at the "eyepoint" position of the uncut lens. Therefore, it was necessary to obtain the lens optical center position by measurement so that the optical properties (the dioptric power and other properties) of the uncut lens were confirmed to satisfy the conditions of the spectacle prescription. By determining the optical center position, the position for attaching the lens holder was obtained as well.

A lens meter, which is used for measuring optical properties of a lens such as the dioptric power and the prism dioptric power, has been used to measure the optical center of the uncut lens. To provide a measurement of the optical center position, the lens meter is used to measure the prism value of the lens at positions considered, or estimated, to be close to the optical center and by finding out the position on the lens where the prism value becomes zero, or by calculating the position of the optical center in accordance with a specific equation using the prism value obtained by the measurement.

However, from a practical standpoint it remains a complicated and difficult process to visually measure the prism value with a lens meter at positions considered to be close to the optical center, and it is even more problematic to find the position having a prism value of zero. Moreover, it is not always possible to accurately determine the position of the optical center using this prior art method. The alternate prior art method for obtaining the position of the optical center by measuring the prism value of the lens near, or approximate to, the optical center and then calculating the optical center position in accordance with a specific equation suffers from the fact that the accuracy is different depending on the position of the measurement. The error in calculating the optical center position is great when the location of the measurement on the lens is far from the true position of the optical center. The strength of this prior art method of calculating the optical center position from a measured prism values is that the accuracy error is small when the location of the actual measurement is close to the true position of the optical center. However, the object is to choose a location that is sufficiently close to the true optical center position to provide an accurate calculated optical center position.

Another problem that has recently occurred is that lenses for spectacle frames having certain shapes are difficult to process; mainly, the typical processing methods of the prior art cannot be conducted because the lens holder can not be attached at the optical center. Specifically, as the preference of people who wear spectacle glasses diversifies, spectacle frames having non-traditional shapes, including very small dimensions in the vertical direction, are becoming more popular. When the spectacle frame has a vertical dimension smaller than a specific value, attaching the lens holder to the optical center results in processing interference taking place because a portion of the outer periphery of the lens holder protrudes beyond of the shape, or borders, of the spectacle frame (the shape to be formed by the processing the uncut glass). Consequently, the processing or grinding of the uncut lens glass into one of these non-traditional shapes with an insufficient vertical dimension becomes impossible.

SUMMARY OF THE INVENTION

The object of the present invention is to provide a method for accurately and efficiently measuring the optical center of a spectacle lens, wherein the method includes a method or steps for attaching a lens holder to a spectacle lens so that the position of the attached lens holder will not produce processing interference during grinding. The object of the invention includes efficiently attaching the lens holder to the spectacle lens and providing an apparatus for attaching the lens holder to a spectacle lens having characteristics described above.

The first preferred embodiment of the present invention provides a method for obtaining a position of the optical center of a spectacle lens comprising the steps of (1) measuring the optical properties of a spectacle lens at a first measured position of the spectacle lens by using a lens meter for measuring the optical properties of the spectacle lens, wherein the optical properties measured include a prism value; (2) calculating the position of the optical center of the spectacle lens using at least the prism value obtained by measuring the optical properties at the first position, wherein the first calculation involves a specific relational equation, then setting the resultant position, being a first estimated position obtained by calculation, as a first calculated position for subsequent calculation of the optical center; (3) concluding that the first calculated position for the optical center is sufficiently equivalent to the true position of the optical center when a distance between the first measured position and the first calculated position of the optical center is equal to or smaller than a specific reference value; (4) when the distance between the first measured position and the first calculated position of the optical center exceeds the specific reference value, measuring the optical properties at the first calculated position of the optical center using the lens meter followed by calculating a second calculated position of the optical center using values of the optical properties obtained by measuring at the first calculated position, wherein the second calculation involves the specific relational equation; (5) concluding that the second calculated position for the optical center is sufficiently equivalent to the true position of the optical center when a distance between the first calculated position and the second calculated position of the optical center is equal to or smaller than the specific reference value; (6) when the distance between the first calculated position of the optical center and the second calculated position of the optical center exceeds the specific reference value, measuring the optical properties at the second calculated position using the lens meter followed by calculating a third calculated position of the optical center using values of the optical properties obtained by measuring at the second calculated position, wherein the third calculation involves the specific relational equation; (7) conducting further steps in a similar manner to those conducted in the above steps in which it is checked whether a distance between successive positions for calculation of the optical center does not exceed the specific value; and (8) when a distance between an (n−1)-th calculated position and an n-th calculated position of the optical center is equal to or smaller than the specific value, determining that the n-th calculated position of the optical center is sufficiently equivalent to the position of the true optical center of the spectacle lens.

The second preferred embodiment of the present invention provides a method for attaching a lens holder to an uncut lens, the lens holder being a jig attached to the uncut lens prior to a process of grinding an edge of the spectacle lens, wherein the lens holder provides a rotational center axis for the uncut lens during the process of grinding, the method comprising steps of: (1) measuring optical properties at a first measured position of the uncut lens using a lens meter for measuring the optical properties of the uncut lens, wherein the optical properties measured includes at least a prism value; (2) calculating a first calculated position of the optical center of the uncut lens using values obtained by measuring the optical properties at the first measured position, wherein the first calculation involves a specific relational equation, then setting the resultant position, being a first estimated position obtained by calculation, as a first calculated position of the optical center; (3) concluding that the first calculated position of the optical center is sufficiently equivalent to the true position of the optical center when a distance between the first measured position and the first calculated position is equal to or smaller than a specific reference value, followed by using the first measured position as the position for attaching the lens holder to the spectacle lens; (4) when the distance between the first measured position and the first calculated position of the optical center exceeds the specific reference value, measuring the optical properties at the first calculated position of the optical center using the lens meter followed by calculating a second calculated position of the optical center using values obtained by measuring at the first calculated position, wherein the second calculation involves the specific relational equation; (5) concluding that the second calculated position for the optical center is sufficiently equivalent to the true position of the optical center when a distance between the first calculated position and the second calculated position of the optical center is equal to or smaller than the specific reference, followed by using the first calculated position of the optical center as the position for attaching the lens holder; (6) when the distance between the first calculated position of the optical center and the second calculated position of the optical center exceeds the specific reference value, measuring the optical properties at the second calculated position using the lens meter followed by calculating a third calculated position of the optical center using values of the optical properties obtained by measuring at the second calculated position, wherein the third calculation involves the specific relational equation; (7) conducting further steps in a similar manner to those conducted in the above steps in which it is checked whether a distance between successive positions for calculation of the optical center does not exceed the specific value; and (8) when a distance between an (n−1)-th calculated position and an n-th calculated position of the optical center is equal to or smaller than the specific value, determining that the n-th calculated position of the optical center is sufficiently equivalent to the position of the true optical center of the spectacle lens, and determining that the (n−1)th calculated position of the optical center is the position for attaching the lens holder.

The third preferred embodiment of the present invention provides a method for attaching a lens holder according to the second preferred embodiment, but further comprises the step of determining whether processing is possible based upon processing information including the shape to be formed by processing the uncut lens and the shape of a lens buildup area of the lens holder assuming that the lens holder attaches at the determined position for attaching the lens holder, followed by initiation of lens processing.

A fourth preferred embodiment of the present invention provides a method for attaching a lens holder according to any one of the second preferred embodiment and the third preferred embodiment of the present invention, wherein information describing the positions obtained during procedures ranging from the method for determining the first calculated position to the method for determining the position for attaching the lens holder to an uncut lens is maintained as transmittable information so that the information can be used as process control information in a numerical control type processing apparatus.

The fifth preferred embodiment of the present invention provides an apparatus for attaching a lens holder to an uncut lens, the lens holder being a jig attached to the uncut lens prior to a process of grinding an edge of a spectacle lens, wherein the lens holder provides a rotational center axis for the uncut lens during the process of grinding, the apparatus comprising: a computer; a lens meter for measuring optical properties of the uncut lens, the lens meter being connected to the computer in a manner such that information measured by the meter is transmissible to the computer, the measured information comprising measurable optical properties of the lens including a prism value; and a movable table on which the uncut lens to be measured by the lens meter is disposed, and which moves to a desired position in accordance with specific control information comprising the measured information, the table comprising a position measuring device for measuring a position of the table that is operationally connected to the computer to allow information exchange between the position measuring device and the computer, wherein the position measuring device outputs position information to the computer, wherein the computer comprises a program for an information processing method comprising the steps of: (1) outputting a control command to the lens meter and the movable table so that optical properties of the uncut lens are measured at a first measured position under the control; (2) calculating a first calculated position of an optical center of the uncut lens using values obtained by measuring optical properties of the lens at the first measured position in accordance with a specific relational equation and setting the resultant position, being a first estimated position obtained by calculation, as a first calculated position of the optical center; (3) concluding that the first calculated position of the optical center is sufficiently equivalent to the true position of the optical center when a distance between the first measured position and the first calculated position is equal to or smaller than a specific reference value, followed by using the first measured position as the position for attaching the lens holder to the spectacle lens; (4) when the distance between the first measured position and the first calculated position of the optical center exceeds the specific reference value, measuring the optical properties at the first calculated position of the optical center using the lens meter followed by calculating a second calculated position of the optical center using values obtained by measuring at the first calculated position, wherein the second calculation involves the specific relational equation; (5) concluding that the second calculated position for the optical center is sufficiently equivalent to the true position of the optical center when a distance between the first calculated position and the second calculated position of the optical center is equal to or smaller than the specific reference, followed by using the first calculated position of the optical center as the position for attaching the lens holder; (6) when the distance between the first calculated position of the optical center and the second calculated position of the optical center exceeds the specific reference value, measuring the optical properties at the second calculated position using the lens meter followed by calculating a third calculated position of the optical center using values of the optical properties obtained by measuring at the second calculated position, wherein the third calculation involves the specific relational equation; (7) conducting further steps in a similar manner to those conducted in the above steps in which it is checked whether a distance between successive positions for calculation of the optical center does not exceed the specific value; and (8) when a distance between an (n−1)-th calculated position and an n-th calculated position of the optical center is equal to or smaller than the specific value, determining that the n-th calculated position of the optical center is sufficiently equivalent to the position of the true optical center of the spectacle lens, and determining that the (n−1)th calculated position of the optical center is the position for attaching the lens holder.

Further objects features and advantages of the present invention will become apparent from the Detailed Description of Preferred Embodiments, which follows, when considered together with the attached drawings.

DETAILED DESCRIPTION OF THE INVENTION

Figure 1:
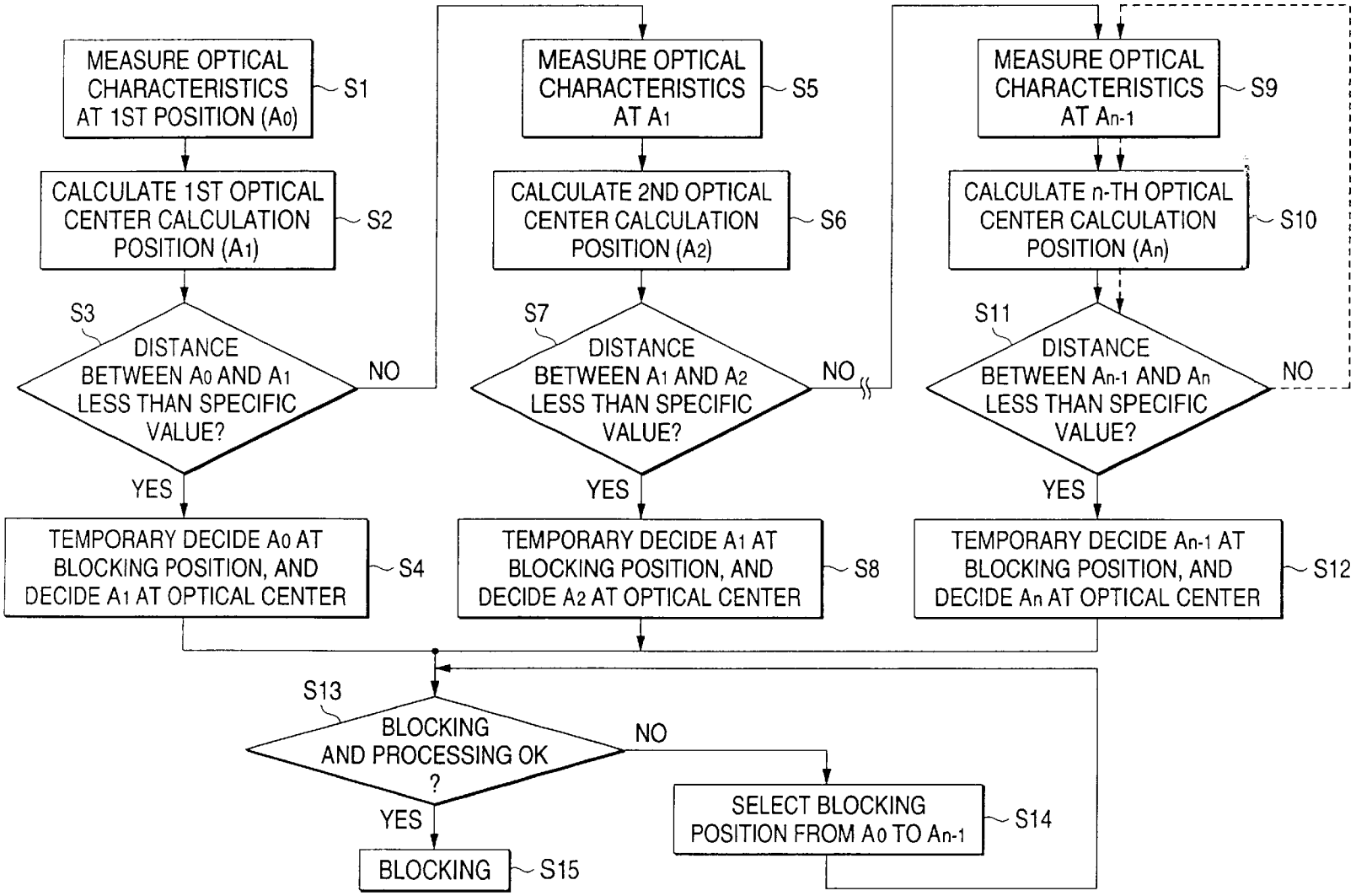
FIG. 1 is a flow chart outlining the steps of the method of the present invention for obtaining the position of the optical center of an uncut spectacle lens and for determining the attachment of a lens holder to the uncut spectacle lens.

FIG. 1 is a flow chart outlining the steps of the method for determining or obtaining the position of the approximate optical center of a spectacle lens and for attaching a lens holder to the approximate optical center of the spectacle lens. This method for obtaining the position of the optical center of a spectacle lens and for attaching a lens holder to the optical center of the spectacle lens, as well as the apparatus for performing the method of the present invention, will be described with reference to FIGS. 1–5.

Referring to FIG. 1, the method for obtaining the position of the optical center of a spectacle lens and for attaching a lens holder to a spectacle lens comprise steps S1 to S12. These steps essentially achieve the following: (1) setting and measuring the position of an uncut lens on an X-Y table which has movable portions for positioning the uncut lens, (2) taking optical measurements of the uncut lens using a lens meter, and (3) performing a blocking operation by a blocking apparatus. To perform these functions, the apparatus of the present invention for attaching a lens holder to a spectacle lens comprises X-Y table 3, lens meter 1, blocking apparatus 2, and computer 4. The apparatus for attaching a lens holder to a spectacle lens of the present invention and its components will be described first, then the method for measuring the optical center of the spectacle lens and for attaching a lens holder to the spectacle lens using the apparatus will be described.

Figure 2:
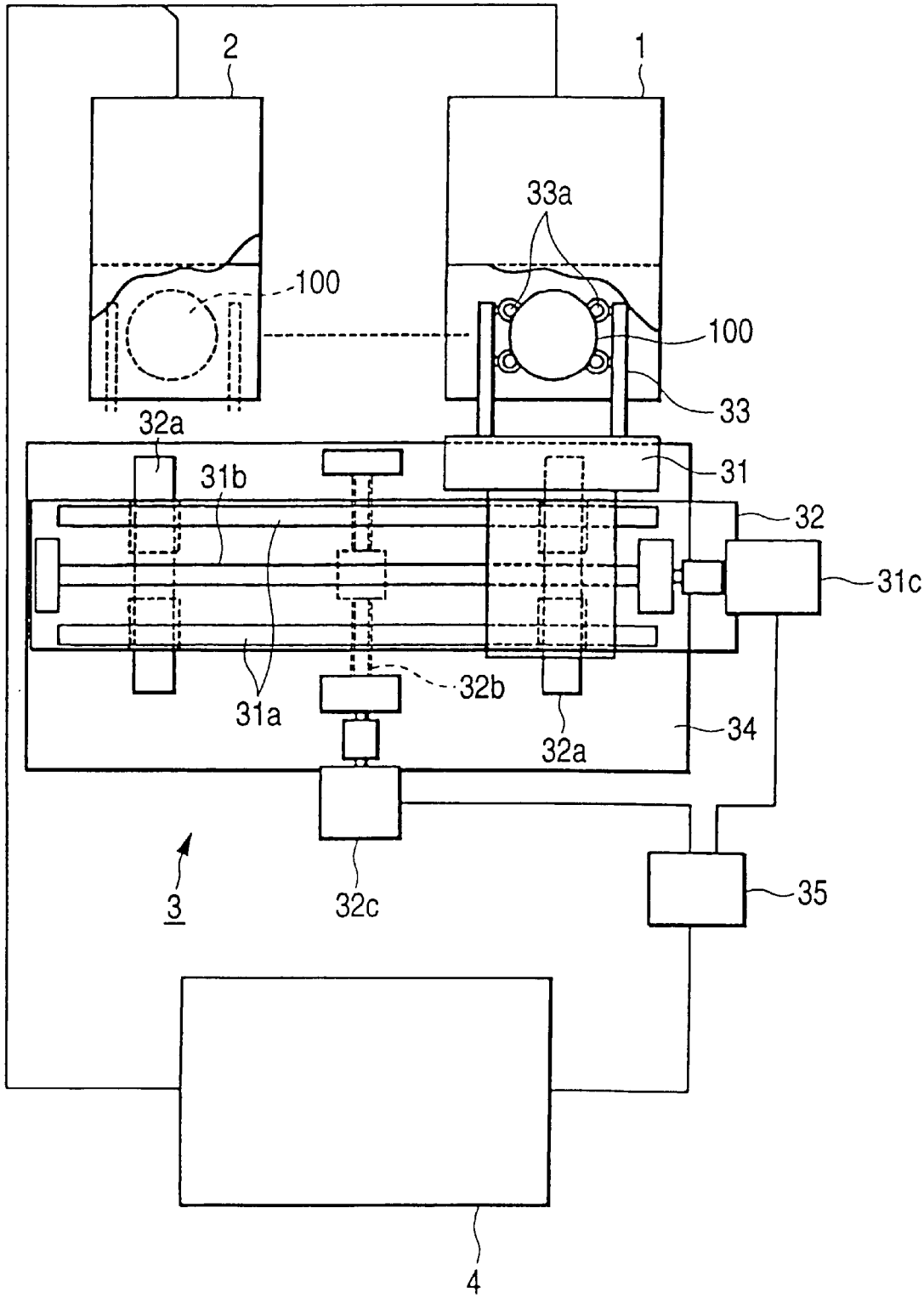
FIG. 2 illustrates the apparatus of the present invention for attaching a lens holder to the approximate optical center of a spectacle lens.
Figure 3:
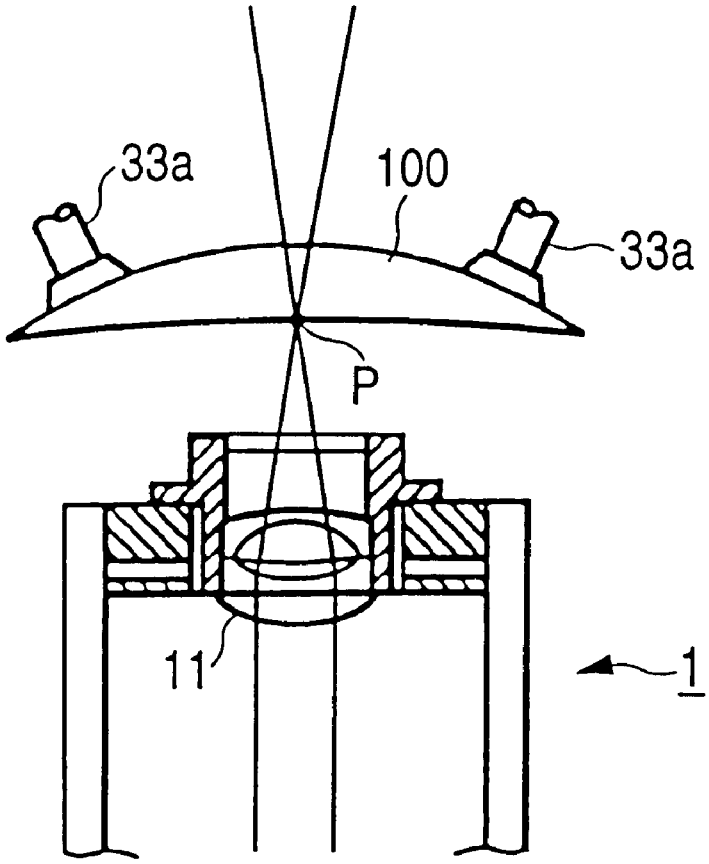
FIG. 3 illustrates measuring a lens prism value using a lens meter.

In FIG. 2, a lens meter 1, a blocking apparatus 2 and an X-Y table 3 are operationally connected to a computer 4 so that information can be exchanged between the computer 4 and the other three components. Information may be transmitted from the computer 4 to each of the other components (lens meter 1, blocking apparatus 2, and X-Y table 3). However, computer 4 performs the operations of controlling the movements and operation of the other components, processes all information collected by the other components that is transmitted to the computer 4, and performs all computations required to operate the apparatus for attaching a lens holder to a spectacle lens. The lens meter 1 is a conventional apparatus for measuring optical properties of an uncut lens 100. The optical properties measured by the lens meter 1 include, but are not limited to, the spherical dioptric power, the cylindrical dioptric power, the angle of the cylinder axis and the prism value of the uncut lens 100. As shown in FIG. 3, a light used in the measurement obtained by the lens meter 1 is focused at position P on the unprocessed lens, i.e., the uncut lens 100) via a collimator lens 11. Position P is the point on the uncut lens 100 where the optical properties are measured by the lens meter 1. Light originating from a source in lens meter 1 that passes through the unprocessed lens 100 travels to an optical system in another portion (not shown in FIG. 3) of lens meter 1 that obtains the measurements of the optical properties of the uncut lens 100.

Figure 4:
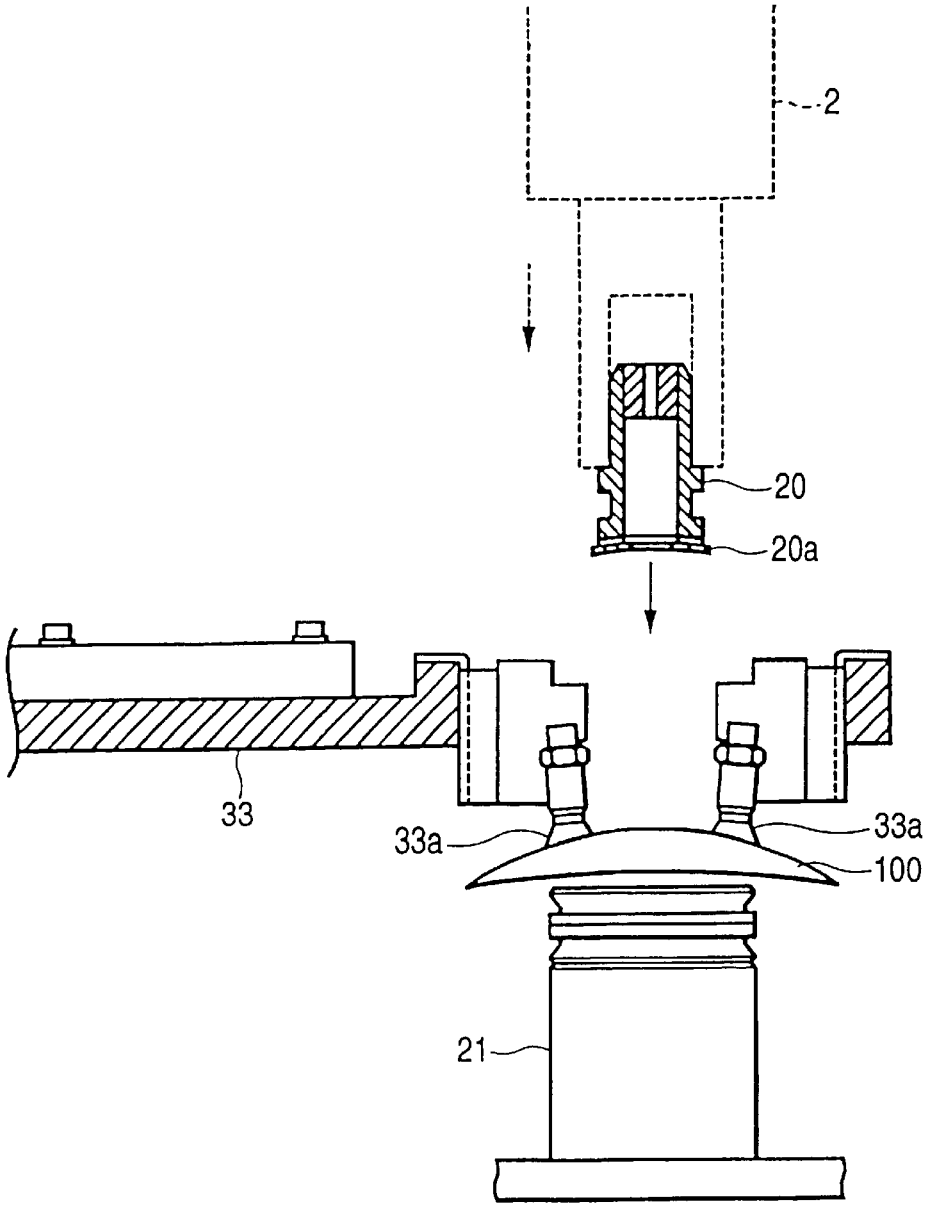
FIG. 4 illustrates the attachment of a lens holder to an uncut lens using a lens blocking apparatus according to the present invention.
Figure 5:
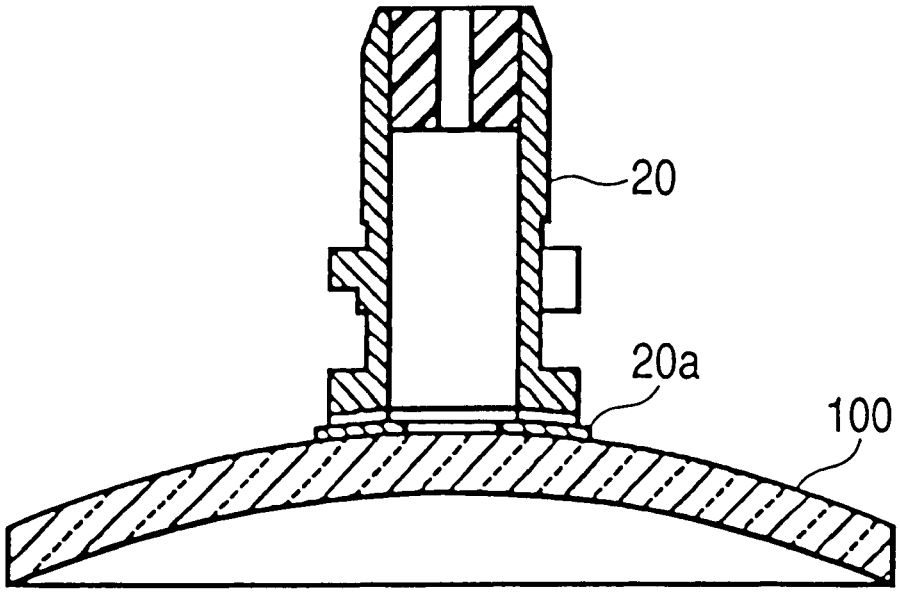
FIG. 5 illustrates attachment of a lens holder to an uncut lens using a lens blocking apparatus according to the present invention.

As shown in FIGS. 4 and 5, the blocking apparatus 2 is a conventional apparatus for supporting a lens holder 20, and pushes or positions the lens holder 20 to the surface of the unprocessed lens 100. Elastic seal 20*a* of the lens holder 20 is used for attaching the lens holder 20 to the lens 100. The unprocessed lens 100 is held in proper position by a portion 33 of the X-Y table 3, wherein this portion 33 is for holding a lens. Another table 21 is used for providing a fixed surface upon which the lens 100 is placed and positioned in a fixed manner so that the central axis of the lens holder 20 can be placed exactly at the desired attachment position on the unprocessed lens 100. Once the lens 100 is properly placed and positioned on fixed table 21, the lens holder is attached to the unprocessed lens 100.

The X-Y table 3 has suction apparatuses 33*a* disposed on the portion 33 for holding a lens. Computer 4, which is electronically connected to the X-Y table 3, is programmed to send control commands to the X-Y table 3 for positioning the portion 33 for holding a lens into proper position and for initiating the suction mechanism of the suction apparatuses 33*a*. In this manner, computer 4 can direct the portion 33 of the XY table 3 to pick up and secure a lens and then to move the lens, such as the unprocessed lens 100, into a proper and secured position for having optical properties measured by the lens meter 1 and for attaching the blocking apparatus 2 to the lens 100. When the lens 100 is in a secured position for being measured by the lens meter 1, the lens 100 is said to be in the "position of measurement." When the lens 100 is in a secured position for being attached to the blocking apparatus 2, it is said to be in the "position of attachment." In the practice of the present invention, the position of measurement and the position of attachment may be the same position or they may be different positions. Lastly, the X-Y table 3 is constructed to have the capability to collect information on the position of the lens and to transmit this information (lens position data) to the computer 4 for processing.

To allow the X-Y table 3 to move the portion 33 for holding a lens, the X-Y table includes an X table 31 and a Y table 32 as shown in FIG. 2. The portion 33 for holding a lens is disposed on the X table 31 so that it moves with the X table 31. The X table 31 is disposed on the Y table 32 so that the X table can move freely in the X-direction on two rails 31*a*. The movement of the X table is performed by rotating a screw shaft 31*b* driven by a driving pulse motor 31*c*. The screw shaft 31*b* is screwed into the X table 31 and attached to the Y table 32 in a manner such that the screw shaft 31*b* can freely rotate. The Y table 32 is disposed on a base table 34 in a manner such that the Y table can freely move in the Y-direction on two rails 32 disposed on the base table 34. The movement of the Y table is performed by rotating a screw shaft 32*b* driven by a driving pulse motor 32*c*. The screw shaft 32*b* is screwed into the Y table 32 and attached to the base table 34 in a manner such that the screw shaft 32*b* can freely rotate. The X motor 31*c* and the Y motor 32*c* are operationally connected to the computer 4 via a controller 35. Computer 4 directs the position of the portion 33 for holding a lens by controlling the operation of the X motor 31*c* and the Y motor 32*c*.

The computer 4 also transmits the necessary control signals to the lens meter 1 and the blocking apparatus 2 in addition to the X-Y table 3. Computer 4 conducts calculations for obtaining the optical center of the lens, determines or decides the position on the lens for attaching the lens holder 20, and controls all of the above apparatuses based on the results of the calculations. Specifically, the computer controls the operable components of the apparatus for attaching a lens holder to an uncut spectacle lens so that the following steps, S1–S15, are performed.

Description of Step S1

The optical properties of the unprocessed lens 100 at a first position A0 on lens 100 are measured by the lens meter 1. First position AO is measured when lens 100 is in a position of measurement, specifically being in the first position of measurement. In this step, the unprocessed lens 100, previously supplied by an apparatus (not shown) for supplying an unprocessed lens, is securely held by the suction generated by the suction apparatuses 33*a* that are part of the portion 33 for holding a lens on the X-Y table 3. In this step, the lens 100 is fixed at the first position of measurement so the unprocessed lens 100 is in position so that the first position AO is properly measured by lens meter 1. In other word, first position AO is a point on the lens 100, wherein the first position of measurement is the position of the lens 100. Once the lens 100 is in the first position of measurement, the computer 4 transmits a command to the lens meter 1, thereby initiating operation of the lens meter 1 and the optical properties of the unprocessed lens such as the spherical dioptric power, the cylindrical dioptric power, the angle of the cylinder axis and the prism amount are measured by the lens meter 1. In the practice of the invention, the first position AO is arbitrarily selected. For example, the first position AO is preferably chosen so that the lens meter 1 will measure the optical properties of the geometrical center of the lens 100, although other choices for the first position AO, and the corresponding first position of measurement, are theoretically possible.

Description of Step S2

The optical properties of the unprocessed lens 100, such as the spherical dioptric power, the cylindrical dioptric power, the angle of the cylinder axis and the prism amount, which have been obtained by the lens meter 1 during step S1, are now transmitted to the computer 4 in step S2. Subsequently, the position of the optical center is determined by calculation performed by computer 4 utilizing the optical property values of lens 100 measured at the AO position by the lens meter 1. Specifically, the values of the optical properties are input into the matrix equation (1) for obtaining the deviation of the position of the measurement from the optical center:

$$\begin{pmatrix} hx \\ hy \end{pmatrix} = -\begin{pmatrix} A' & B' \\ C' & D' \end{pmatrix}\begin{pmatrix} Px \\ Py \end{pmatrix}, \quad (1)$$

wherein hx is the deviation in the X-direction, hy is the deviation in the Y-direction, Px is the prism amount in the X-direction, Py is the prism amount in the Y-direction, $$A' = \frac{S + C\cos^2\theta}{S(S+C)},$$

$$B' = \frac{C\sin\theta\cos\theta}{S(S+C)},$$

$$C' = \frac{C\sin\theta\cos\theta}{S(S+C)},$$

$$D' = \frac{S + C\sin^2\theta}{S(S+C)},$$

$S$ is the spherical dioptric power, $C$ is the cylindrical dioptric power, and $\theta$ is the angle of the cylinder axis.

The deviation of the first position AO from the optical center is determined using matrix equation (1). The first estimated optical center thus obtained by calculation is set by the program of computer 4 to be the first calculated position A1 of the optical center. In other words, first calculated position A1 is the first calculated approximation to the optical center as calculated by the program operating in computer 4, and this calculated approximation is based upon the optical properties of lens 100 at the first measured position AO, wherein the first position AO is typically the geometrical center of the lens 100.

Description of Steps S3 and S4

Steps S3 and S4 determine if the first calculated position A1 is sufficiently equivalent to the true optical center of the lens 100. Determining what is "sufficiently equivalent" to the true optical center of the lens 100 is defined by calculating the difference, being a deviation distance or deviation, between the first measured position A0 and the first calculated position A1 obtained by computer 4. Simply, computer 4 determines the absolute difference ("distance") between the first measured position AO and the first calculated position A1 and compares this distance to a specific reference value. In practice, the specific reference value is the largest distance between the measured position and the calculated position that is preset in the program of computer 4 to be considered to be sufficiently equivalent to the true optical center.

Specifically in step S3, computer 4 calculates the distance between the first measured position AO and the first calculated position A1, then checks or compares this deviation distance to the specific reference value. When the deviation distance is equal to or less than the specific reference value (also referred to as the "reference distance"), the computer decides that the first calculated position A1 is sufficiently equivalent to the true optical center and proceeds to Step S4. When the deviation distance exceeds the reference distance, then computer 4 proceeds to step S5.

The specific reference value is arbitrarily chosen; however, in practice it is prudent to use, for example, 0.01 mm as the prism value. This prism value is suitably selected to be the deviation distance (specific reference value) because this value represents the greatest allowable value for the distance between the optical center of the lens and the position of the pupil of the person who will be wearing the pair of eyeglasses when the spectacle lens is fitted into the spectacle frame before noticeable problems in vision occur.

In step S4, the first calculated position A1 has been determined to be sufficiently equivalent to the position of the true optical center so position A1 is set as the position of the true optical center, and the first measured position AO is temporarily determined to be the position for attaching the lens holder 20 to the lens 100.

Description of Step S5

When the deviation distance between the first measured position AO and the first calculated position A1 exceeds the specific reference value, the program operating in computer 4 advances to step S5. In step S5, the position of measurement is reset from A0 to A1, and computer 4 commands lens meter 1 to measure the prism value and the other optical property values as obtained and described in step S1. In other words, the first calculated position A1 is treated as the new position on lens 100 where optical properties will be measured. Computer 4 directs the X-Y table 3 to reposition lens 100 so that in step S5 the optical properties of position A1 are measured by lens meter 1 so that these values can be used to calculate a second calculated position A2 in the subsequent steps.

Description of Step S6

The spherical dioptric power, the cylindrical dioptric power, the angle of the cylinder axis and the prism amount measured at position A1 of the unprocessed lens 100 by the lens meter 1 are transmitted to computer 4 in the manner described in step S2. Computer 4 receives and processes the transmitted data comprising the optical property measurements at the A1 position and recalculates the position of the optical center utilizing these optical property measurements at the A1 position and equation (1). In other words, step S6 calculates a second calculated position A2, being a second calculated approximation of the true optical center of lens 100 using essentially the same process of and being analogous to Step S2, except that the measured position on lens 100 is now A1 and the result of the calculation is the second calculated position A2. The optical center thus obtained is set as the second calculated position A2 of the optical center.

Description of Steps S7 and S8

Steps S7 and S8 are analogous to previous steps S3 and S4, respectively. In step S7, the deviation distance between the first calculated position A1 and the second calculated position A2 is calculated by computer 4 using the method described in step S3. In step S7, computer 4 checks or compares this deviation distance to the specific reference value, which is the same specific reference value, or reference distance, used in step S3. When the deviation distance is equal to or less than the specific reference distance, computer 4 decides that the second calculated position A2 is sufficiently equivalent to the true optical center and proceeds to Step S8. When the deviation distance exceeds the reference distance, then computer 4 proceeds to step S9. In step S8, the second calculated position A2 has been determined to be sufficiently equivalent to the position of the true optical center so position A2 is set as the position of the true optical center, and the first calculated position A1 is temporarily determined to be the position for attaching the lens holder 20 to the lens 100.

Description of Step S9

When the deviation distance between the first calculated position A1 and the second calculated position A2 exceeds the specific reference value, the program operating in computer 4 advances to step S9. In step S9, the position of measurement is reset from A1 to A2, and computer 4 commands lens meter 1 to measure the prism value and the other optical property values as obtained and described in step S1 or step S5. In other words, the second calculated position A2 is treated as the new measured position on lens 100. The program operating in computer 4 now proceeds to step S10, wherein it is the optical properties of position A2 that are measured by lens meter 1 so that these values can be used to calculate a third calculated position A3.

Description of Steps S10 to S12

Steps S10–S12 respectively are analogous to previous steps S6–S8. The prism value and the other optical property values of the lens 100 obtained in step S9 and transmitted to computer 4 are inputted into the matrix equation (1) and the n-th calculated position An, being the nth approximation of the true optical center of lens 100, is calculated in step S10. In step S1, the deviation distance is calculated as the absolute difference between the (n−1)-th calculated position An−1 and the n-th calculated position An (the deviation) using the method as described in steps S3 and S7. Computer 4 then checks or compares the deviation distance to the reference distance used in steps S3 and S7. When the deviation distance does not exceed the specific reference value, meaning that when the deviation distance is equal to or smaller than the reference distance, then the program operating computer 4 decides that the nth calculated position is sufficiently equivalent to the true optical center and advances to step S12.

In step S12, the n-th calculated position An has been determined to be sufficiently equivalent to the position of the true optical center so position An is set as the position of the true optical center, and the (n−1)-th calculated position An−1 is temporarily determined to be the position for attaching the lens holder 20.

When the deviation distance between the (n−1)-th calculated position An−1 and the n-th calculated position An exceeds the specific reference value, the program operating computer 4 returns to step S9. The program operating in computer 4 continues to recycle through steps S9–S11 of the present invention, generating a fourth calculated position A4, and a fifth calculated position A5, and so on until the nth calculated position wherein the deviation distance between the nth calculated position and the (n−1)th position is finally equal to or smaller than the reference distance.

In summary, the method of the present invention includes calculating an approximation of the true optical center of the lens 100, initially by using optical property measurement data as described in steps S1–S4, but if the first calculated approximation is not sufficiently equivalent to the true optical center as determined by comparing a deviation distance to a reference distance, then the calculation proceeds to steps S5–S8. If the second calculated approximation generated by steps S5–S7 is not sufficiently equivalent to the true optical center, then the method proceeds to steps S9–S12. If the third calculated approximation generated by steps S9–S11 is not sufficiently equivalent to the true optical center, then the calculation recycles or reiterates steps S9–S11 (also referred to the "reiterative process") until a subsequently calculated nth approximation is sufficiently equivalent to the true optical center by meeting the termination criteria that the deviation difference be equal to or smaller than the reference distance. Plainly, it would be appreciated by one skilled in the art that the optical center calculation (steps S1–S12) performed by computer 4 could terminate at step S4, or at step S8, or at the first pass through steps S9–S12, or could run through steps S9–S11 any number of times before terminating at step S12. The calculation described by steps S1–S12 runs until the termination criteria is reached, which is having a deviation distance equal to or smaller than the reference distance. It would also be appreciated by one skilled in the art that the lens meter 1 would be measuring optical properties on the lens 100 until the (n−1)th calculated position is measured because the (n−1)th calculated position is used to calculate the nth calculated position wherein the nth calculated position is the approximation satisfying the termination criteria.

Description of Step S13

When the termination criteria is met at either step S4, S8 or S12, the program operating in computer 4 advances to step 13. In step S13, computer 4 determines whether processing interference would take place. As discussed previously, processing interference may occur when the lens holder 20 is blocked ("attached") to the lens 100 at the (n−1)th calculated position, which had been temporarily determined in step S4, S8, or S12 to be the position for attaching the lens holder 20 of the blocking apparatus 2. In the art, this position for attaching the lens holder 20 is also known as the blocking position, and the word "block" is often used to mean attached to the blocking apparatus 2. In other words, using the data describing the shape of the spectacle frame, the data describing the lens prescription, and the data describing the shape (the diameter) of the lens holder, computer 4 decides whether processing interference would take place when the lens holder 20 is blocked to the lens 100 at the position temporarily determined to be the position for blocking.

Description of Step S14

When computer 4 decides in step S13 that processing interference would take place, the program running computer 4 advances to step S14. In step S14, a temporary position for blocking the lens holder 20 to the lens 100 is selected from one of the previously determined positions A0 to An−1, which have been obtained using the position of the geometrical center of the shape of the spectacle frame and by using the measurements collected in steps S1–S12. One of the positions A0 to An−1 is selected as the new temporary blocking position in place of the temporary position An decided in step S12. The program operating computer 4 returns to step S13 and the new temporary blocking position is analyzed using the same calculation for determining process interference and based upon the same data describing the shape of the spectacle frame, the data describing the lens prescription, and the data describing the shape (the diameter) of the lens holder. Subsequently, step S14 is repeated when computer 4 determines that processing interference would take place. Steps S13 and S14 continue to repeat in a cycle or loop until step S13 determines or estimates that processing interference would be absent.

Description of Step S15

When step S13 determines that processing interference would not take place, the program operating computer 4 advances to step S15 and blocking is conducted. The unprocessed lens 100, held by the X-Y table, is transferred to the blocking apparatus 2. The transfer of lens 100 to blocking apparatus 2 occurs by positioning the lens 100 into the position of attaching ("blocking"), or blocking position, followed by blocking lens 100 to the blocking apparatus 2 via lens holder 20. Overall, the lens processing arrangement, which includes the apparatus for attaching the lens holder to a lens and the lens processing apparatus (not shown), preferably a numerical control apparatus, is made so that the information determined by computer 4 on the decided positions, such as the position of the optical center and the blocking position, is transferred to the processing apparatus as a portion of the processing data used in the processing of the lens 100.

In accordance with the above described methods, the optical constants and the position of the optical center of a lens are accurately and efficiently determined because the distance between the true optical center and the finally estimated or calculated position of the measurement is equal to or smaller than the reference distance, thereby ensuring that the estimated and decided position of measurement is sufficiently equivalent to the true optical center. In addition, successful and efficient blocking can be achieved because the apparatus of the present invention determines in advance whether processing of the lens at the blocking position is possible without processing interference.

As described above, the present invention provides a method for obtaining the position of the optical center of a spectacle lens in steps of: (1) measuring optical properties at a first measured position of the spectacle lens using a lens meter for measuring the optical properties of the spectacle lens, the measured optical properties including at least a prism value; (2) calculating the position of the optical center of the spectacle lens using the values obtained measuring the optical properties at the first measured position, wherein the first calculation involves a specific relational equation, then setting the resultant first estimated position obtained by the calculation to be a first calculated position of the optical center; (3) when a distance between the first measured position and the first calculated position of the optical center is equal to or smaller than a specific value, determining that the first calculated position of the optical center is sufficiently equivalent to the true position of the optical center, and setting the first calculated position to be the true optical center; (4) when the distance between the first measured position and the first calculated position of the optical center exceeds the specific value, measuring the optical properties at the first calculated position of the optical center using the lens meter, and calculating a second calculated position of the optical center using the values obtained by measuring at the first calculated position, wherein the second calculation involves the specific relational equation; (5) when a distance between the first calculated position and the second calculated position of the optical center is equal to or smaller than the specific value, determining that the second calculated position of the optical center is sufficiently equivalent to the true position of the optical center; (6) when the distance between the first calculated position and the second calculated position of the optical center exceeds the specific value, measuring the optical properties at the second calculated position of the optical center using the lens meter followed by calculating a third calculated position of the optical center using values obtained by measuring at the second calculated position, wherein the third calculation involves the specific relational equation; (7) conducting further steps in a similar manner to those conducted in the above steps in which it is checked whether a distance between successive positions for calculation of the optical center does not exceed the specific value; and (8) when a distance between an (n−1)-th calculated position and an n-th calculated position of the optical center is equal to or smaller than the specific value, determining that the n-th calculated position of the optical center is sufficiently equivalent to the position of the true optical center of the spectacle lens.

Also in accordance with the above described method of the present invention, an estimate of the optical center An−1 can be accurately and efficiently obtained, and the lens holder can be attached to this position without the occurrence of processing interference.

While the present invention has been described with reference to certain preferred embodiments, one of ordinary skill in the art will recognize that additions, deletions, substitutions, modifications and improvements can be made while remaining within the spirit and scope of the present invention as defined by the appended claims.

What is claimed is:

1. A method for obtaining a position of an optical center of a spectacle lens comprising the steps of:

(a) measuring optical properties at a first measured position on a spectacle lens using a lens meter for measuring the optical properties of a spectacle lens, wherein the lens meter obtains values for the measured optical properties including a prism value;

(b) calculating a first estimated position for the optical center of the spectacle lens using the values obtained by measuring the optical properties at the first measured position, wherein calculation of the first estimated position involves a specific relational equation, followed by setting the resultant first estimated position to be a first calculated position of the optical center;

(c) concluding that the first calculated position of the optical center is sufficiently equivalent to a position of the true optical center when a distance between the first measured position and the first calculated position of the optical center is equal to or smaller than a specific reference value;

(d) when the distance between the first measured position and the first calculated position of the optical center exceeds the specific reference value, measuring the optical properties at the first calculated position of the optical center using the lens meter and calculating a second calculated position of the optical center using values obtained by measuring at the first calculated position, wherein calculation of the second calculated position involves the specific relational equation;

(e) concluding that the second calculated position of the optical center is sufficiently equivalent to the position of the true optical center when a distance between the first calculated position and the second calculated position of the optical center is equal to or smaller than the specific reference value;

(f) when the distance between the first calculated position and the second calculated position of the optical center exceeds the specific reference value, entering a reiterative process comprising the steps of measuring the optical properties at the preceding calculated position of the optical center using the lens meter followed by calculating a subsequent calculated position of the optical center using the values obtained measuring at the preceding calculated position, wherein calculation of the subsequent calculated position involves the specific relational equation, concluding the reiterative process and concluding that the subsequent calculated position of the optical center is sufficiently equivalent to the position of the true optical center when a distance between the preceding calculated position and the subsequent calculated position is equal to or less than the specific reference value, and repeating the reiterative process steps of measuring a preceding calculated position followed by calculating a subsequent calculated position when the distance between the preceding calculated position and the subsequent calculated position exceeds the specific reference value;

(g) terminating the method when it is concluded that a calculated position of the optical center is sufficiently equivalent to a position of the true optical center.

2. A method for attaching a lens holder to an uncut lens, the lens holder comprising a jig attached to the uncut lens prior to a process of grinding an edge of a spectacle lens, wherein the lens holder provides a rotational center axis for the uncut lens during the process of grinding, the method comprising steps of:

(a) measuring optical properties at a first measured position on the uncut lens using a lens meter for measuring the optical properties of an optical lens, wherein the lens meter obtains values for the measured optical properties including a prism value;

(b) calculating a first estimated position for the optical center of the uncut lens using the values obtained by measuring the optical properties at the first measured position, wherein calculation of the first estimated position involves a specific relational equation, followed by setting the resultant first estimated position to be a first calculated position of the optical center;

(c) concluding that the first calculated position of the optical center is sufficiently equivalent to a position of the true optical center when a distance between the first measured position and the first calculated position of the optical center is equal to or smaller than a specific reference value;

(d) when the distance between the first measured position and the first calculated position of the optical center exceeds the specific reference value, measuring the optical properties at the first calculated position of the optical center using the lens meter and calculating a second calculated position of the optical center using values obtained by measuring at the first calculated position, wherein calculation of the second calculated position involves the specific relational equation;

(e) concluding that the second calculated position of the optical center is sufficiently equivalent to the position of the true optical center when a distance between the first calculated position and the second calculated position of the optical center is equal to or smaller than the specific reference value;

(f) when the distance between the first calculated position and the second calculated position of the optical center exceeds the specific reference value, entering a reiterative process comprising the steps of measuring the optical properties at the preceding calculated position of the optical center using the lens meter followed by calculating a subsequent calculated position of the optical center using the values obtained measuring at the preceding calculated position, wherein calculation of the subsequent calculated position involves the specific relational equation, concluding the reiterative process and concluding that the subsequent calculated position of the optical center is sufficiently equivalent to the position of the true optical center when a distance between the preceding calculated position and the subsequent calculated position is equal to or less than the specific reference value, and repeating the reiterative process steps of measuring a preceding calculated position followed by calculating a subsequent calculated position when the distance between the preceding calculated position and the subsequent calculated position exceeds the specific reference value; and (g) determining a position for attaching the lens holder to be a calculated position concluded to be sufficiently equivalent to the true optical center.

3. A method for attaching a lens holder according to claim 2, further comprising the step of determining whether processing is possible based on processing information including a shape to be formed by processing the uncut lens and a shape of a lens buildup area of the lens holder assuming that the lens holder attaches at the previously determined position for attaching the lens holder, followed by initiation of uncut lens processing.

4. A method for attaching a lens holder according to claim 2, further comprising the step of maintaining information describing the positions obtained by either measurement or calculation in any previous step so that the information is in a transmittable condition to be transmitted as process control information to a processing apparatus of a numerical control type.

5. A method for attaching a lens holder according to claim 3, further comprising the step of maintaining information describing the positions obtained by either measurement or calculation in any previous step so that the information is in a transmittable condition to be transmitted as process control information to a processing apparatus of a numerical control type.

6. A method for producing a spectacle lens comprising the steps of (a)providing an uncut lens;

(b)performing a layout analysis including obtaining a position of an optical center of the uncut lens, wherein the step of obtaining the position of the optical center comprises:

(i) measuring optical properties at a first measured position on a spectacle lens using a lens meter for measuring the optical properties of a spectacle lens, wherein the lens meter obtains values for the measured optical properties including a prism value;

(ii) calculating a first estimated position for the optical center of the spectacle lens using the values obtained by measuring the optical properties at the first measured position, wherein calculation of the first estimated position involves a specific relational equation, followed by setting the resultant first estimated position to be a first calculated position of the optical center;

(iii) concluding that the first calculated position of the optical center is sufficiently equivalent to a position of the true optical center when a distance between the first measured position and the first calculated position of the optical center is equal to or smaller than a specific reference value;

(iv) when the distance between the first measured position and the first calculated position of the optical center exceeds the specific reference value, measuring the optical properties at the first calculated position of the optical center using the lens meter and calculating a second calculated position of the optical center using values obtained by measuring at the first calculated position, wherein calculation of the second calculated position involves the specific relational equation;

(v) concluding that the second calculated position of the optical center is sufficiently equivalent to the position of the true optical center when a distance between the first calculated position and the second calculated position of the optical center is equal to or smaller than the specific reference value;

(vi) when the distance between the first calculated position and the second calculated position of the optical center exceeds the specific reference value, entering a reiterative process comprising the steps of measuring the optical properties at the preceding calculated position of the optical center using the lens meter followed by calculating a subsequent calculated position of the optical center using the values obtained measuring at the preceding calculated position, wherein calculation of the subsequent calculated position involves the specific relational equation, concluding the reiterative process and concluding that the subsequent calculated position of the optical center is sufficiently equivalent to the position of the true optical center when a distance between the preceding calculated position and the subsequent calculated position is equal to or less than the specific reference value, and repeating the reiterative process steps of measuring the preceding calculated position followed by calculating the subsequent calculated position when the distance between the preceding calculated position and the subsequent calculated position exceeds the specific reference value; and (vii) determining that a calculated position concluded to be sufficiently equivalent to the position of the true optical center of the optical lens is the optical center of the lens; and (c) processing the uncut lens using an apparatus for processing an uncut lens to produce the spectacle lens.

7. A method for producing a spectacle lens comprising the steps of:

(a) providing an uncut lens;

(b) attaching a lens holder to the uncut lens, the lens holder comprising a jig for attaching to the uncut lens prior to a process of grinding an edge to produce a spectacle lens, wherein the lens holder provides a rotational center axis for the uncut lens during the process of grinding, wherein the step of attaching the lens holder to the uncut lens comprises:

(i) measuring optical properties at a first measured position on a spectacle lens using a lens meter for measuring the optical properties of a spectacle lens, wherein the lens meter obtains values for the measured optical properties including a prism value;

(ii) calculating a first estimated position for the optical center of the spectacle lens using the values obtained by measuring the optical properties at the first measured position, wherein calculation of the first estimated position involves a specific relational equation, followed by setting the resultant first estimated position to be a first calculated position of the optical center;

(iii) concluding that the first calculated position of the optical center is sufficiently equivalent to a position of the true optical center when a distance between the first measured position and the first calculated position of the optical center is equal to or smaller than a specific reference value;

(iv) when the distance between the first measured position and the first calculated position of the optical center exceeds the specific reference value, measuring the optical properties at the first calculated position of the optical center using the lens meter and calculating a second calculated position of the optical center using values obtained by measuring at the first calculated position, wherein calculation of the second calculated position involves the specific relational equation;

(v) concluding that the second calculated position of the optical center is sufficiently equivalent to the position of the true optical center when a distance between the first calculated position and the second calculated position of the optical center is equal to or smaller than the specific reference value;

(vi) when the distance between the first calculated position and the second calculated position of the optical center exceeds the specific reference value, entering a reiterative process comprising the steps of measuring the optical properties at the preceding calculated position of the optical center using the lens meter followed by calculating a subsequent calculated position of the optical center using the values obtained measuring at the preceding calculated position, wherein calculation of the subsequent calculated position involves the specific relational equation, concluding the reiterative process and concluding that the subsequent calculated position of the optical center is sufficiently equivalent to the position of the true optical center when a distance between the preceding calculated position and the subsequent calculated position is equal to or less than the specific reference value, and repeating the reiterative process steps of measuring the preceding calculated position followed by calculating the subsequent calculated position when the distance between the preceding calculated position and the subsequent calculated position exceeds the specific reference value; and (vii) attaching the lens holder to a calculated position concluded to be sufficiently equivalent to the position of the true optical center of the optical lens is the optical center of the lens; and (c) processing the uncut lens using an apparatus for processing an uncut lens to produce the spectacle lens.

8. A method for producing a spectacle lens according to claim 7, wherein the step for attaching the lens holder to the uncut lens further comprises the step of determining whether processing is possible based on processing information including a shape to be formed by processing the uncut lens and a shape of a lens buildup area of the lens holder assuming that the lens holder attaches at the previously determined position for attaching the lens holder, followed by initiation of uncut lens processing.

9. A method for producing a spectacle lens according to claim 7, wherein the step for attaching the lens holder to the uncut lens further comprises the step of maintaining information describing the positions obtained by either measurement or calculation in any previous step so that the information is in a transmittable condition to be transmitted as process control information to a processing apparatus of a numerical control type.

10. A method for producing a spectacle lens according to claim 8, wherein the step for attaching the lens holder to the uncut lens further comprises the step of maintaining information describing the positions obtained by either measurement or calculation in any previous step so that the information is in a transmittable condition to be transmitted as process control information to a processing apparatus of a numerical control type.

11. An apparatus for attaching a lens holder to an uncut lens, the lens holder comprising a jig attachable to an uncut lens prior to initiating a process of grinding an edge of an uncut lens to produce a spectacle lens, wherein the jig provides a rotational center axis for an uncut lens during the process of grinding, the apparatus comprising:

(a) a computer;

(b) a lens meter for measuring optical properties of an uncut lens, the lens meter being operationally connected to the computer so that information can be exchanged between the lens meter and the computer, wherein the optical properties measurable by the lens meter includes a prism value; and (c) a movable table for securing an uncut lens to be measured by the lens meter, wherein the movable table is operationally connected to the computer so that information can be exchanged between the movable table and the computer and so that the movable table moves to a position of measurement in response to control information provided by the computer, and the movable table obtains position information describing the position of the movable table so that the movable table transmits the position information to the computer; wherein the computer is an information processor capable of performing the steps of.

(i) outputting a control command to the lens meter and the movable table so that optical properties of the uncut lens are measured at a first measuring position;

(ii) calculating a first estimated position for the optical center of the spectacle lens using the values obtained by measuring the optical properties at the first measured position, wherein calculation of the first estimated position involves a specific relational equation, followed by setting the resultant first estimated position to be a first calculated position of the optical center;

(iii) concluding that the first calculated position of the optical center is sufficiently equivalent to a position of the true optical center when a distance between the first measured position and the first calculated position of the optical center is equal to or smaller than a specific reference value;

(iv) when the distance between the first measured position and the first calculated position of the optical center exceeds the specific reference value, measuring the optical properties at the first calculated position of the optical center using the lens meter and calculating a second calculated position of the optical center using values obtained by measuring at the first calculated position, wherein calculation of the second calculated position involves the specific relational equation;

(v) concluding that the second calculated position of the optical center is sufficiently equivalent to the position of the true optical center when a distance between the first calculated position and the second calculated position of the optical center is equal to or smaller than the specific reference value;

(vi) when the distance between the first calculated position and the second calculated position of the optical center exceeds the specific reference value, entering a reiterative process comprising the steps of measuring the optical properties at the preceding calculated position of the optical center using the lens meter followed by calculating a subsequent calculated position of the optical center using the values obtained measuring at the preceding calculated position, wherein calculation of the subsequent calculated position involves the specific relational equation, concluding the reiterative process and concluding that the subsequent calculated position of the optical center is sufficiently equivalent to the position of the true optical center when a distance between the preceding calculated position and the subsequent calculated position is equal to or less than the specific reference value, and repeating the reiterative process steps of measuring the preceding calculated position followed by calculating the subsequent calculated position when the distance between the preceding calculated position and the subsequent calculated position exceeds the specific reference value; and (vii) determining a position the lens holder is to be attached to be a calculated position concluded to be sufficiently equivalent to the position of the true optical center of the optical lens is the optical center of the lens.

* * * * *